United States Patent [19]

Favrot

[11] 4,221,080

[45] Sep. 9, 1980

[54] WORK-TABLES OF GRINDING MACHINES

[75] Inventor: Paul Favrot, Gagny, France

[73] Assignee: Constructions de Clichy, France

[21] Appl. No.: 961,683

[22] Filed: Nov. 17, 1978

[30] Foreign Application Priority Data

Nov. 22, 1977 [FR] France ..... 77 34990

[51] Int. Cl.[3] ..... B24B 5/04

[52] U.S. Cl. ..... 51/105 SP; 51/237 R; 51/237 CS

[58] Field of Search ..... 51/95 R, 95 WH, 103 R, 51/105 R, 232, 233, 236, 237 R, 237 CS, 215 R, 215 CS, 103 C, 105 SP; 82/28 R, 8, 9, 21 R

[56] References Cited

U.S. PATENT DOCUMENTS

| | | | |
|---|---|---|---|
| 1,912,956 | 6/1933 | Weisbrod | 51/237 R |
| 2,526,796 | 10/1950 | Asbridge | 51/105 R |
| 2,576,497 | 11/1951 | Austin, Sr. et al. | 51/237 R |
| 2,933,863 | 4/1960 | Doll | 51/237 R |
| 3,182,426 | 5/1965 | Vrsecky | 51/237 R |
| 3,574,974 | 4/1971 | Weissing | 51/237 R |

FOREIGN PATENT DOCUMENTS

| | | | |
|---|---|---|---|
| 252111 | 2/1970 | U.S.S.R. | 51/237 R |

*Primary Examiner*—Harold D. Whitehead
*Assistant Examiner*—K. Bradford Adolphson
*Attorney, Agent, or Firm*—George H. Gerstman

[57] ABSTRACT

The grinding machine essentially comprises a frame on which a grinding-wheel slide is capable of moving towards a workpiece carried by a sliding table designed in two separate parts or table components, one of which is adapted to carry a headstock while the other carries a tailstock. The two table components are provided with means for controlling their movements in opposite directions and the tailstock table component is subjected to the action of a restoring spring for urging it towards the headstock table component.

3 Claims, 4 Drawing Figures

WORK-TABLES OF GRINDING MACHINES

BACKGROUND OF THE INVENTION

This invention relates to a grinding machine of the type which essentially comprises a frame for the displacement of the grinding-wheel slide along the frame towards a workpiece to be ground which is carried by a sliding table.

Up to the present time, the workpiece to be ground has been supported between two centers mounted respectively in a headstock fitted with means for driving the workpiece in rotation and in a tailstock, the headstock being stationarily fixed in an invariable location on the sliding table and the tailstock being mounted on the same table at a location which is variable as a function of the length of the workpiece to be ground.

This conventional arrangement, however, is subject to disadvantages. In point of fact, the back center is mounted within the tailstock by means of a sliding sheath in order that it may be moved away from the center which is mounted within the headstock each time it proves necessary to remove one workpiece in order to replace it by another. The presence of this sliding sheath makes it necessary to give the tailstock larger overall dimensions than would be the case if the back center were permanently fitted directly within the tailstock. In consequence, interferences are liable to take place between the tailstock and the wheel slide, especially when this latter is inclined with respect to the direction of the sliding table. This results in the need to increase the minimum diameter corresponding to permissible wear of the grinding-wheel and consequently in higher operating costs.

Moreover, the movement of withdrawal of the back center at the time of a change of workpiece takes place in opposition to a powerful restoring spring and consequently with a relatively short length of travel. This means that the end of the workpiece which is mounted on the tailstock is well freed as a result of this movement; but in order to disengage the other end of the workpiece from the center, it is either necessary to subject it to a slight movement of axial translation or to displace the table to the corresponding extent. However, a limited amount of space is available between the ends of the workpiece and the two centers, which often proves to be a source of difficulty in the design and operation of automatic workpiece changers.

SUMMARY OF THE INVENTION

The aim of the invention is to improve the work-tables under consideration in order to overcome the abovementioned disadvantages of conventional tables.

To this end and in accordance with the invention, the work-table is designed in two separate parts hereinafter designated as "table components", one of which is adapted to carry the headstock and the other is adapted to carry the tailstock, these two table components being each provided with means for controlling their displacements in opposite directions. The table component which carries the tailstock is subjected to the action of a restoring spring for urging this latter towards the table component which carries the headstock and the back center is mounted in a fixed location within the tailstock.

By virtue of this particular structure, provision is no longer made for a sliding sheath within the tailstock in order to carry the back center since this latter is fitted directly within the body of the tailstock. At the same time, the restoring spring is no longer housed within the interior of the tailstock but beneath the corresponding table component. The result thereby achieved is a very substantial reduction in overall size of the tailstock and consequently in the interferences which arose from the fact that the conventional table was designed in one piece. Moreover, the simultaneous displacements in opposite directions of the two portions of the table in accordance with the invention permit disengagement of each end of the workpiece with respect to the center and with respect to the back center over a relatively substantial distance without subjecting the workpiece to any sliding motion along its axis either in one direction or in the other; replacement of workpieces is thus greatly facilitated, especially if this operation is performed by means of an automatic loading appliance.

A more complete understanding of the invention will be gained from the following description and from the accompanying drawings in which one embodiment of a grinding machine provided with a work-table in accordance with the invention is shown by way of example, and in which.

DETAILED DESCRIPTION OF THE INVENTION

Figure 1:
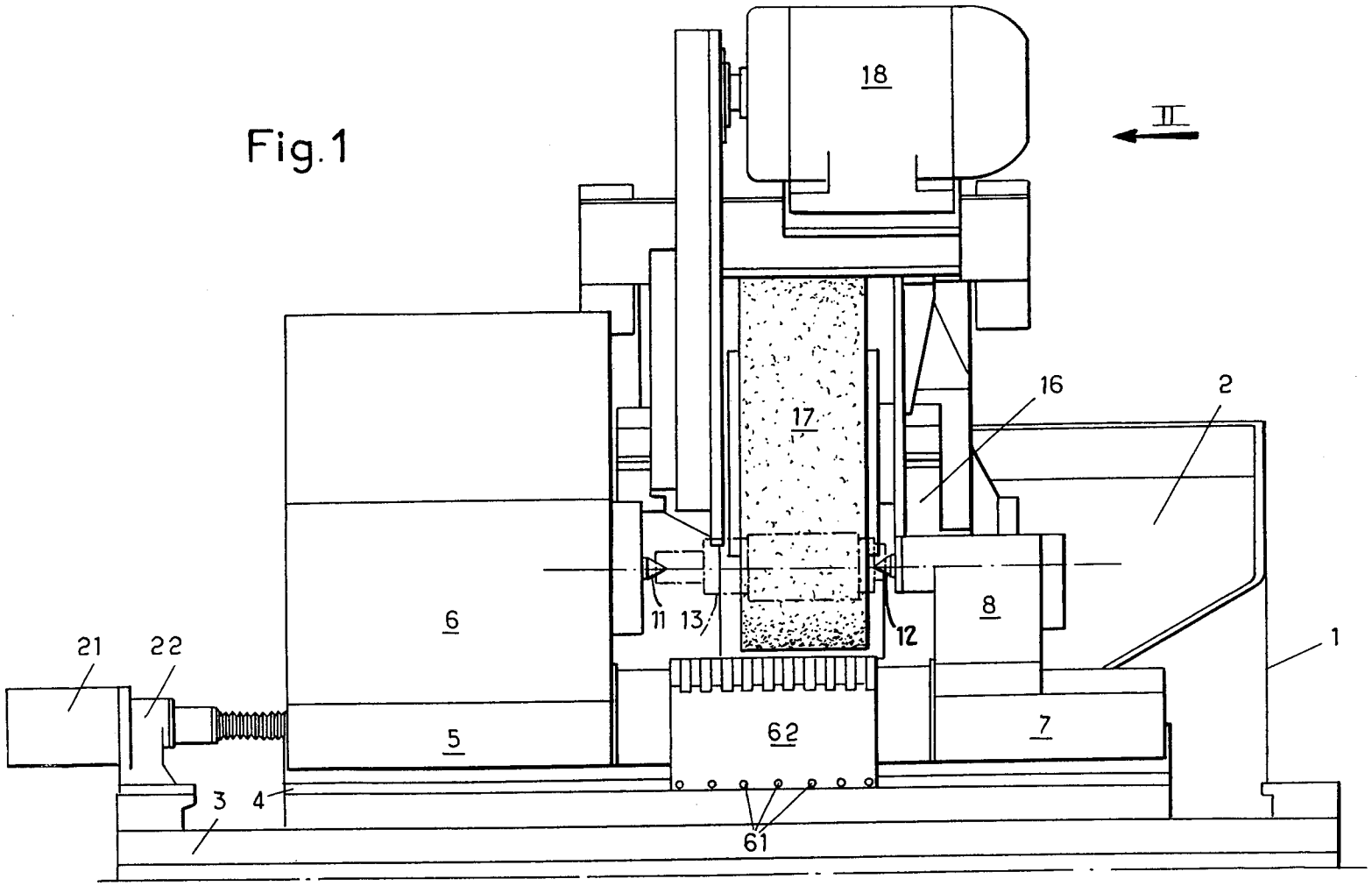
FIG. 1 is a front view of a production grinding machine with a work-table in accordance with the invention.
Figure 2:
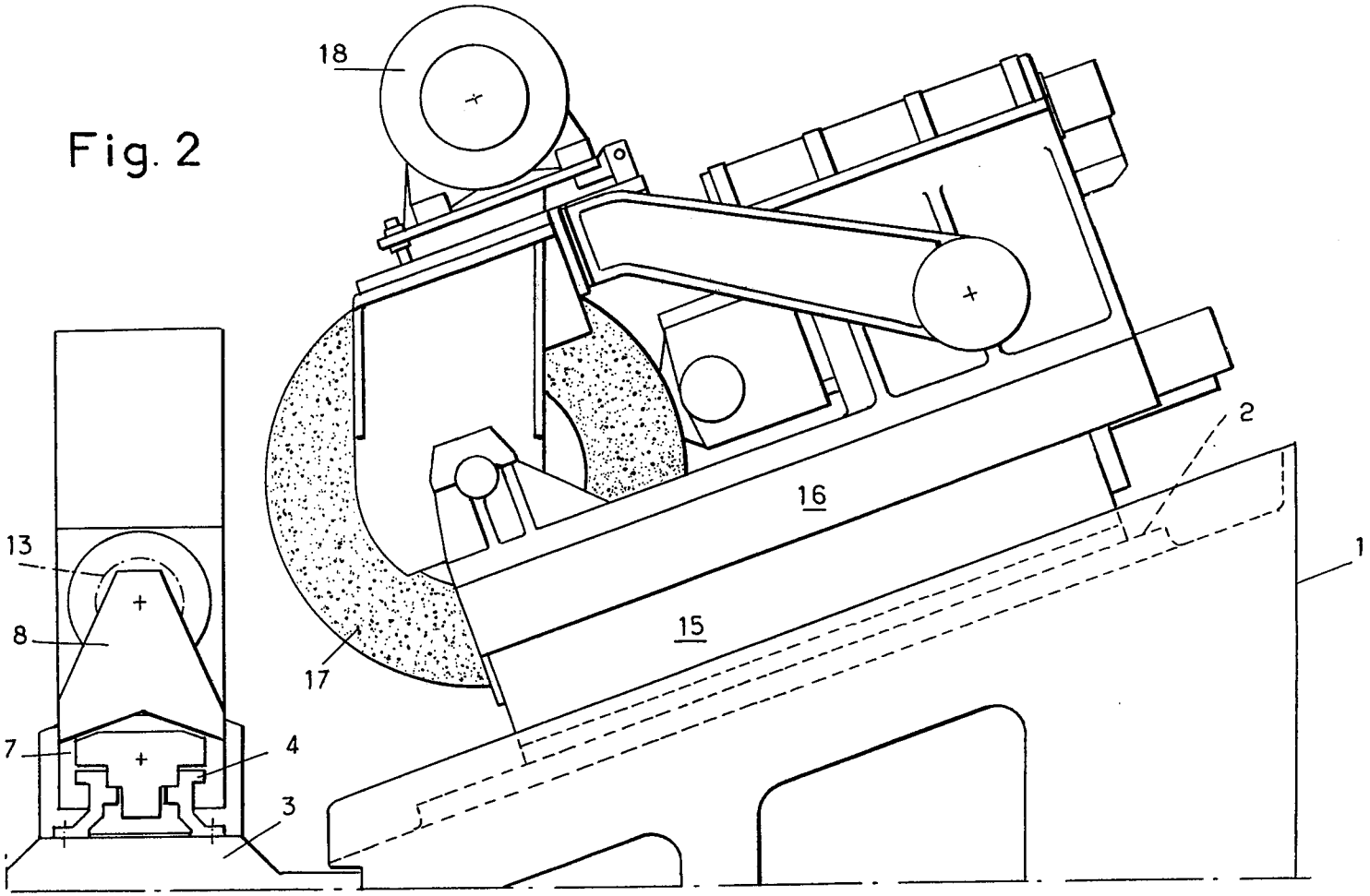
FIG. 2 is a corresponding profile view.

The production grinding machine which is generally illustrated in FIGS. 1 and 2 essentially comprises a frame 1, the upper portion of which forms a stationary inclined table 2, and a bed 3 provided in the upper portion thereof with slideways 4 for supporting a moving table component 5 which carries a headstock 6 and x a moving table component 7 which carries a tailstock 8. The headstock 6 and the tailstock 8 are provided respectively with a center 11 and with a back center 12 between which a workpiece 13 to be ground can be mounted.

On the stationary table 2 is bolted a slide plate 15 on which is mounted a slide 16 for carrying a grinding-wheel 17, said wheel being driven in rotation from an electric motor 18 by means of a belt drive system (not shown in the drawings).

Figure 3:
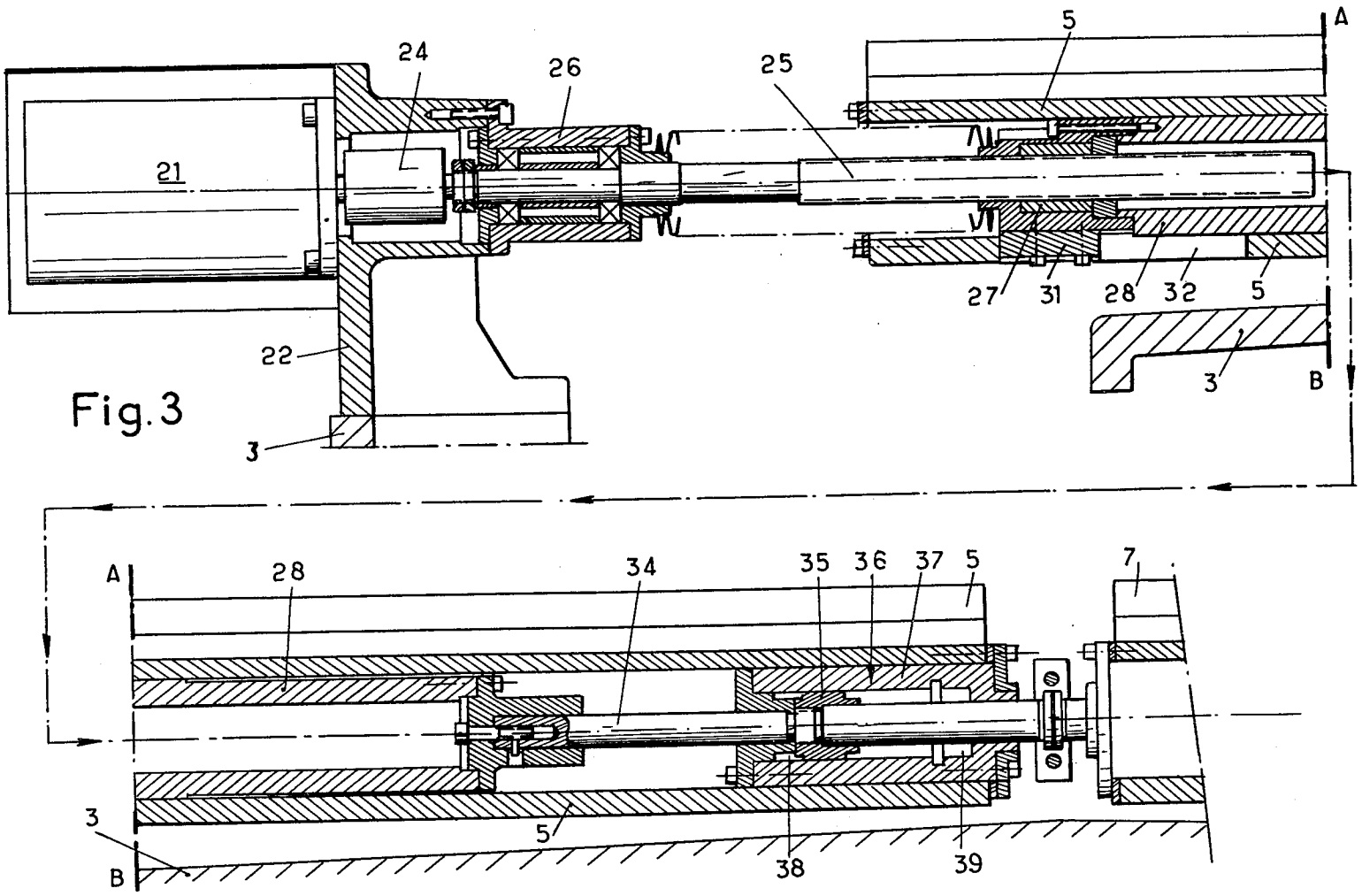
FIGS. 3 and 4 are vertical part-sectional views to a larger scale showing the devices for controlling the displacements of the headstock table component and the tailstock table component respectively.
Figure 4:
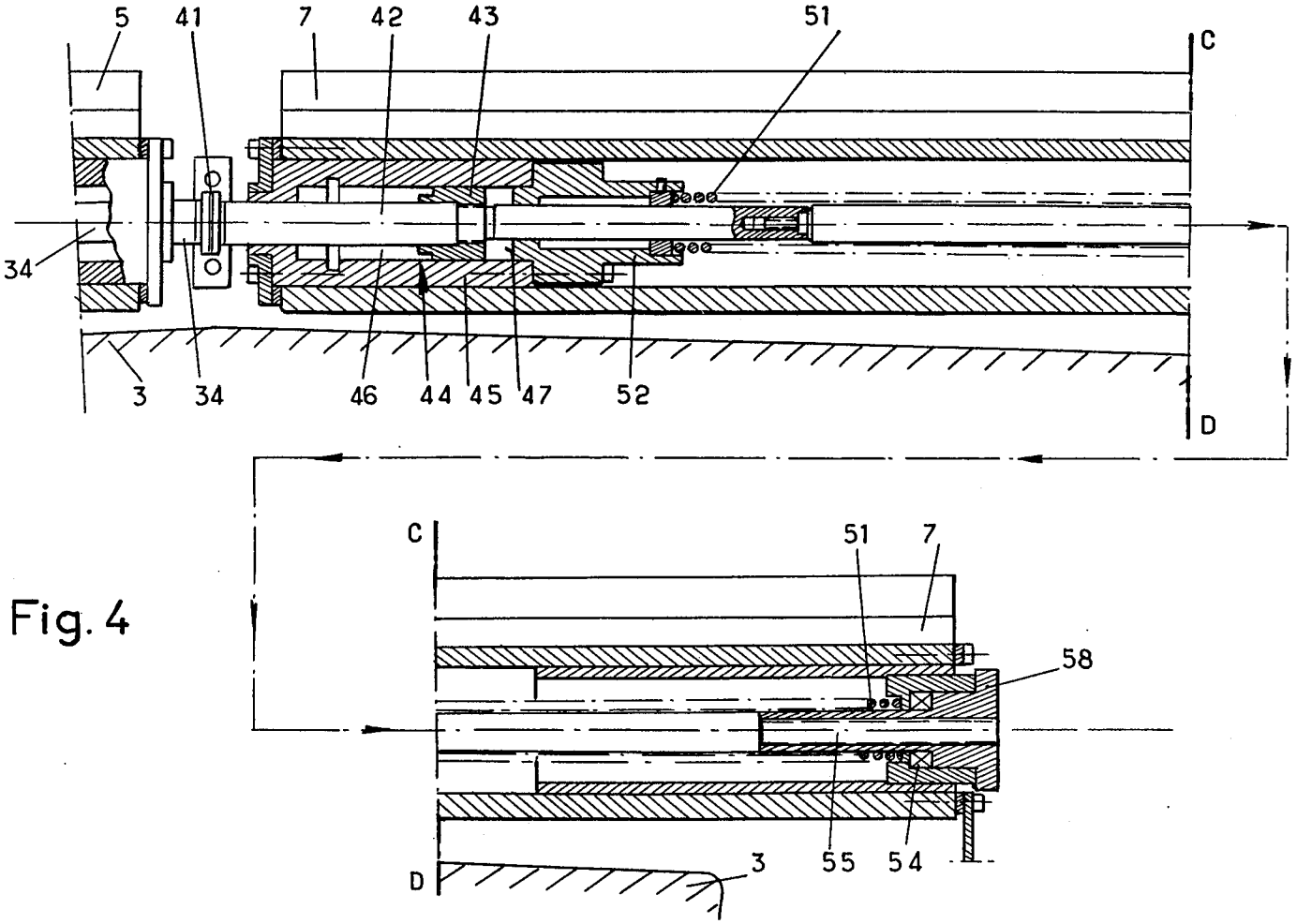

The headstock table component 5 and the tailstock table component 7 can be positioned simultaneously with accuracy on the bed 3 by means of a reduction-gear stepping electric motor 21 through a transmission system which is shown in detail in FIGS. 3 and 4. This transmission system further comprises means for moving said two table components rapidly towards and away from each other without destroying their reference position-setting when replacing a workpiece which has just been ground by a fresh workpiece.

The reduction-gear stepping motor 21 (shown in FIG. 3) is fixed on a support 22 which is bolted on the bed 3. By means of a coupling 24, said motor drives a screw 25, the adjacent end of said screw being rotatably mounted in a bearing 26 which is also attached to the support 22. The screw 25 is engaged in a nut 27 fixed on one end of a tubular member 28 which is capable of sliding within the headstock table component 5. A projecting rib 31 which is rigidly fixed to the nut 27 is slidably mounted in a slot 32 of the table 5 and prevents rotation of said nut. A piston rod 34 is secured to the other end of the tubular member 28 and is rigidly fixed to a piston 35 forming part of a hydraulic jack 36, the cylinder 37 of which is rigidly fixed to the table component 5. In other words, the piston rod 34 is therefore connected to the fixed bed 3 by means of the drive mechanism consisting of screw 25 and nut 27 and the headstock table component 5 is connected to said piston rod by means of the hydraulic jack 36.

The table component 7 which carries the tailstock 8 is also connected to said piston rod 34 by means of a coupling 41 (as shown in FIG. 4) and by means of a piston rod 42 rigidly fixed to a piston 43 forming part of a hydraulic jack 44, the cylinder 45 of which is rigidly fixed to said table. Moreover, said table component is continuously subjected to the action of a spring 51, one end of said spring being applied against a member 52 which is secured to the cylinder 45 of the hydraulic jack 44 and consequently rigidly fixed to the table component 7. The other end of said spring 51 is applied by means of a ball-thrust bearing 54 against a nut 58 for manual adjustment of the tension of the spring 51, said nut being engaged on a screw 55 which is rigidly fixed to the piston rod 42.

Finally, there is fixed on the slideways 4 of the fixed bed 3 by means of screws 61 a sheet steel support in the form of a bridge 62 on which there can be mounted appliances for measuring and accurate axial positioning of workpieces 13 to be ground with respect to the grinding-wheel, that is to say for positioning the table components 5 and 7 on the fixed bed 3 instead of having recourse to swan-neck supports as was the case in conventional machines in which the headstock and tailstock are carried by a common table.

The operation of the machine is as follows:

It will not be necessary to give further consideration to the movements of the grinding-wheel 17 and of the slide 16 which carries the wheel since these latter are of conventional design. However, the movements of the headstock table component and of the tailstock table component which constitute the original feature of the present invention will now be described in detail.

In FIGS. 3 and 4, the two parts of the work-table or so-called table components 5 and 7 are illustrated in the work position in these figures. In other words, a workpiece 13 which is undergoing a grinding operation is mounted between the centers 11, 12 of the headstock and of the tailstock respectively. The position of the headstock table component 5 on the bed 3 is defined on the one hand by the angular position of the screw 25 within the nut 27 and on the other hand by the position of the piston 35 of the hydraulic jack 36 which is abuttingly applied against the left-hand end (as shown in FIG. 3) of the jack cylinder 37 under the action of the pressure of oil admitted into the right-hand chamber 39 of said jack. The positional location of the tailstock table component 7 is defined by the back center 12 (shown in FIG. 1) as this latter comes into cntact with the workpiece 13 to be ground, under the action of the spring 51 which thrusts the tailstock table component 7 towards the headstock table component 5 as said spring is finally applied against the screw 25 having a fixed axial position with respect to the bed 3, by means of the screw 55 (shown in FIG. 4), then by means of the piston rod 42, the coupling 41, the piston rod 34 (see also FIG. 3), the tubular member 28 and the nut 27. It is readily apparent that, during this work-cycle period of the machine, the two chambers 46, 47 (FIG. 4) of the hydraulic jack 44 are connected to the collector-tank as is chamber 38 of hydraulic jack 36; while chamber 39 is connected to the source of oil pressure.

In order to replace the workpiece 13 which has now been ground by a fresh workpiece, it is necessary to move the headstock table component 5 and the tailstock table component 7 away from each other. To this end, oil under pressure is fed into the chamber 38 (FIG. 3) of the jack 36 and the jack chamber 39 is connected to the collector-tank. This has the effect of initiating a displacement of the headstock table component 5 towards the left, that is to say in the direction which moves said component away from the tailstock table component 7. At the same time, oil under pressure is fed into the chamber 47 (FIG. 4) of the jack 44 while leaving the chamber 46 of this latter connected to the collector-tank. This produces a displacement of the tailstock table component towards the right while compressing the spring 51 to a slightly greater extent, namely in the direction which moves it away from the headstock table component. Thus the workpiece is released at the same time at the center 11 and the back center 12, that is to say at both ends and consequently under conditions which are highly favorable for replacement of said workpiece, especially by means of an automatic loading device. After the fresh workpiece has been placed in position between centers, the pressure is restored within the chamber 39 of the jack 36 while the chamber 38 of this latter is connected to the collector-tank and the chamber 47 of the jack 42 is connected to the collector-tank in order to revert to the initial work position conditions.

Initial axial positioning of the workpiece 13 to be ground is obtained by simultaneous positioning of the two table components 5 and 7 by means of the drive system consisting of screw 25 and nut 27 which is driven by the reduction-gear stepping motor 21 (as shown in FIG. 3).

In order to take into account the total length of the workpiece 13 to be ground which may be variable, it is possible to insert between the two piston rods 34 and 42 an extension of suitable length, the two ends of which are rigidly fixed respectively to said piston rods by means of couplings such as the coupling 41, for example.

In one example of construction, it is possible by means of the knob 58 (shown in FIG. 4) to adjust the force of the spring 51 for returning the tailstock table component towards the headstock table component to a value within the range of approximately 30 to 100 kg as a function of the dimensions of the workpiece 13 to be ground and of the type of work to be performed on this latter.

The hydraulic circuits and the distribution devices which form part of these jacks 36 and 44 have not been illustrated in detail since they are of any suitable and conventional type, the jack cylinders being connected to said circuits by means of flexible hoses.

As can readily be understood, the invention is not limited to the embodiment hereinabove described with reference to the accompanying drawings. Thus, depending on the applications which are contemplated, many alternative forms of construction within the capacity of anyone versed in the art can be contemplated without thereby departing either from the scope or the spirit of the invention.

We claim:

1. A grinding machine for finishing a workpiece, comprising a frame, a slide mounted to reciprocate on said frame, a grinding-wheel and means rotatably supporting said grinding-wheel for rotation relative to the slide, a bed secured adjacent said frame and elongated crosswise to the movement of the slide, two separate work table components slidably mounted on said bed, a headstock and a tailstock respectively supported on the work table components, and centers mounted in said headstock and tailstock respectively adapted to support opposite ends of the workpiece, two jack cylinders respectively fixed rigidly to said two work table components in coaxial relation along said bed, two jack pistons respectively mounted operatively in said two jack cylinders and common rod means rigidly connecting said two jack pistons together, spring means inserted between one end of said rod means and the jack cylinder fixed to the tailstock carrying work table component operable for resiliently urging the tailstock carrying work table component towards the headstock carrying work table component to bottom the centers against the workpiece for holding the workpiece, adjustable means connecting the other end of said rod means to said bed operable upon actuation for simultaneously shifting said headstock and said tailstock and the workpiece carried thereby in bulk in the same direction axially along the bed, and said two jack cylinders and jack pistons forming two jacks and means selectively operable to power the jacks effective to shift said headstock and said tailstock in opposite directions, either toward one another or away from one another for effectively loading and unloading the workpiece relative to the centers.

2. A grinding machine according to claim 1, wherein said one end of said rod means is screw-threaded, and a manually operable adjustment nut is engaged on said screw-threaded end of said rod means, said spring means bearing against said nut for allowing adjustment of the effective force of said spring means.

3. A grinding machine according to either claim 1 or 2, wherein said rod means is made of two separate rod parts, the rod means further comprising coupling means of variable length depending on the distance to be set between said tailstock and said headstock according to the length of the workpiece to be finished, said coupling means being operatively inserted between said two rod parts.

* * * * *